US005906545A

United States Patent [19]

Eden et al.

[11] Patent Number: 5,906,545

[45] Date of Patent: May 25, 1999

[54] ROLLERCROSS-TYPE RINK DESIGN

[75] Inventors: Robert Eden, Palm Springs; Tim Lowry, Burbank, both of Calif.

[73] Assignee: Eden Enterprises, Palm Springs, Calif.

[21] Appl. No.: 09/112,477

[22] Filed: Jul. 9, 1998

Related U.S. Application Data

[60] Provisional application No. 60/075,340, Feb. 20, 1998.

[51] Int. Cl.[6] ..... A63C 19/10

[52] U.S. Cl. ..... 472/92; 472/89

[58] Field of Search ..... 472/89, 88, 90, 472/92; 14/69.5, 2.4; 473/415, 416, 446, 471

[56] References Cited

U.S. PATENT DOCUMENTS

| | | | |
|---|---|---|---|
| 594,331 | 11/1897 | Crossley | 472/89 |
| 1,091,484 | 3/1914 | Cohn | 472/89 |
| 4,883,267 | 11/1989 | Burley | 472/90 |
| 5,524,310 | 6/1996 | Farnen | 472/89 X |
| 5,643,094 | 7/1997 | Marci et al. | 472/92 |

*Primary Examiner*—Kien T. Nguyen

*Attorney, Agent, or Firm*—Hoffman, Wasson & Gitler

[57] ABSTRACT

An inline floor hockey playing surface including a substantially horizontal planar main playing surface provided with a goal or net close to either end of the playing surface and opposite thereto. A ramped half-pipe surface surrounds the horizontal planar surface. An upper deck platform surrounds the top of the ramped half-pipe surface. Side walls and end walls enclose the upper deck platform. Players can utilize both the ramped half-pipe surface as well as the upper deck platform surface during game competitions.

14 Claims, 3 Drawing Sheets

ROLLERCROSS-TYPE RINK DESIGN

This application claims the benefit of U.S. provisional application Ser. No. 60/075,340 filed on Feb. 20, 1998.

BACKGROUND OF THE INVENTION

Dating back to the 15th century, American Indians played lacrosse. The game's main purpose was to settle tribal disputes and more importantly, to prepare and toughen warriors for battle. Legend has it that team selection and victories supernaturally controlled. Equipment and players are still ritually prepared by ceremonies that resemble those practiced before departing on the war path. Non-indians witnessing this game likened the sticks used to play the game to the "crosier", which were carried by bishops as a symbol of their office. Hence the name lacrosse. In the 1800's in Montreal, non-indians took up the game lacrosse and has since been designated as the national sport of Canada. The United States, England, Ireland, Scotland and Australia all play lacrosse and complete on the international level. Touted as the fastest game on two feet, lacrosse is considered to be an arduous test of strength and endurance.

Due to its cold winter weather, Canadians also participated greatly in the sport of ice hockey, which is considered to be the fastest game on two skates. Obviously, since ice hockey is placed on ice, it's playing time is limited to outdoor rinks or ponds in cold weather, as well as indoor rinks both in warm and cold weather. However, due to the rapid increase in popularity of ice hockey, particularly in the United States, rink time is often difficult to obtain and is limited in nature.

The invention of inline skates brought the world the ultimate cross training mechanism for ice hockey. Although conventional roller skates have been used to play a floor version of hockey, inline skates most closely simulates the moves on ice and the uncompromising maneuverability that makes ice hockey so fast and exciting. Now a viable sport in its own right, and the fastest-growing team sport in America at the present time, inline roller hockey has captured the majority of the inline market. The organizations that support the sport of inline hockey have nurtured the ranks of recreational skaters to skilled team play with future opportunities at the college level and professional sports.

Aggressive skating is one of the fastest-growing individual segments of inline skating. Freeform dance of risky "aggressive" tricks are performed on rails and ramps with ballet-like motion on inline skates. The sport is urban, extreme and artistic, exuding an attitude emulated by today's youth.

U.S. Pat. No. 4,172,593, issued to Palakanis, is directed to a roller skating rink having a FIG. 8 shaped track including a pair of banked opposite end sections connected to a pair of intermediate sections. As shown particularly with respect to FIGS. 1, 3 and 4, the banked section 34 raises to a maximum height of approximately 18 feet above the horizontally disposed portion and it attains its full height throughout a 60° central angle indicated by the numeral 35 in FIG. 1. However, as illustrated in the Palakanis patent, this banked section only extends around each end of the roller skating rink.

U.S. Pat. No. 5,524,310, issued to Farnen, describes a portable half pipe including an elevated section 42*d* as well as an arcuate track assembly 44*d* supported at its upper end by backing beams 34*d*, at its mid-arc by support truss structure 36*d* and at its bottom by base beam 32*d*. As specifically stated in this patent, platform 42*d* provides a surface upon which skaters can stand and rest while not skating on the half pipe 20. Clearly, this elevated platform 42*d* as well as the entire skateboard ramp described in the Farnen patent is not designed to allow a skater to entirely skate around the periphery of a horizontal planar surface.

U.S. Pat. No. 5,599,025, to Pobee-Mensah, as well as U.S. Pat. No. 5,312,109, issued to Cagle, describe enclosed surfaces for playing a ball game. Both of these patents include sidewalls as well as end walls for maintaining the ball as well as the players within the playing surface. However, neither of these patents include a ramped surface as well as an elevated upper deck platform which completely surround the playing surface.

SUMMARY OF THE INVENTION

The present invention is directed to a game combining various features of inline skating and lacrosse creating a unique blend of extreme individual skills what rely on expert cohesive team play. This game requires high-speed maneuvers, fast passing and dramatic free-form vertical skills thereby creating a visually exciting experience for the spectator and thrilling and competitive play for the participant. The players use a netted stick similar to a lacrosse stick allowing the ball to be moved along at speeds exceeding that of an ice hockey puck or lacrosse ball.

The sport is played on a unique playing surface combining the half-pipe concept of inline skating with the traditional rink playing field of hockey, with the exception that the periphery of the playing field would be curved rather than straight, which is conducive to inline skating. The main level playing area would utilize the same floor markings as roller hockey.

Other features and objects of the invention will be apparent from the following detailed description taken in conjunction with the following drawings.

DETAILED DESCRIPTION OF THE DRAWINGS

DETAILED DESCRIPTION OF THE INVENTION

Figure 1:
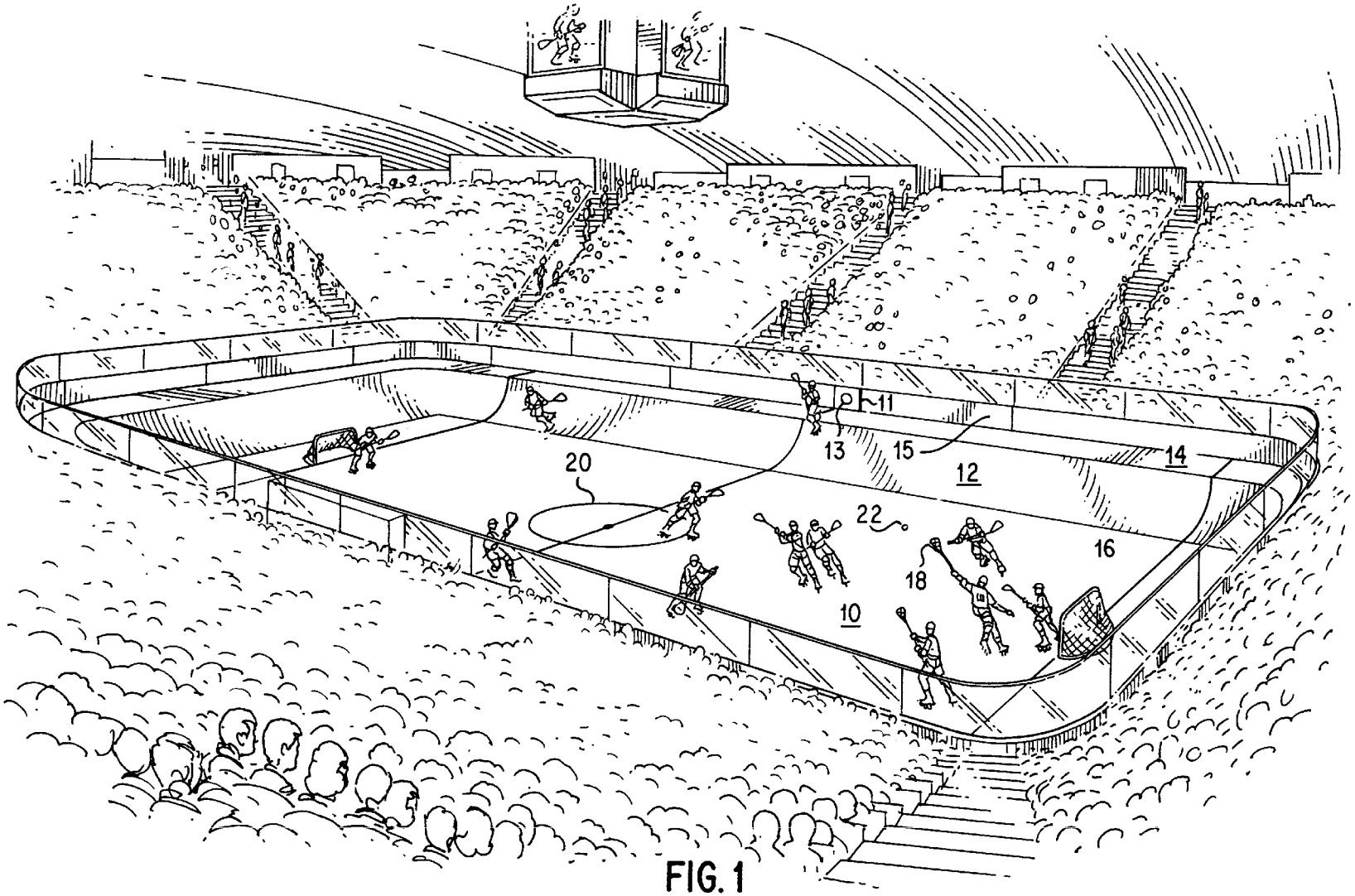
FIG. 1 is a perspective drawing of the rollercross playing surface.
Figure 2:
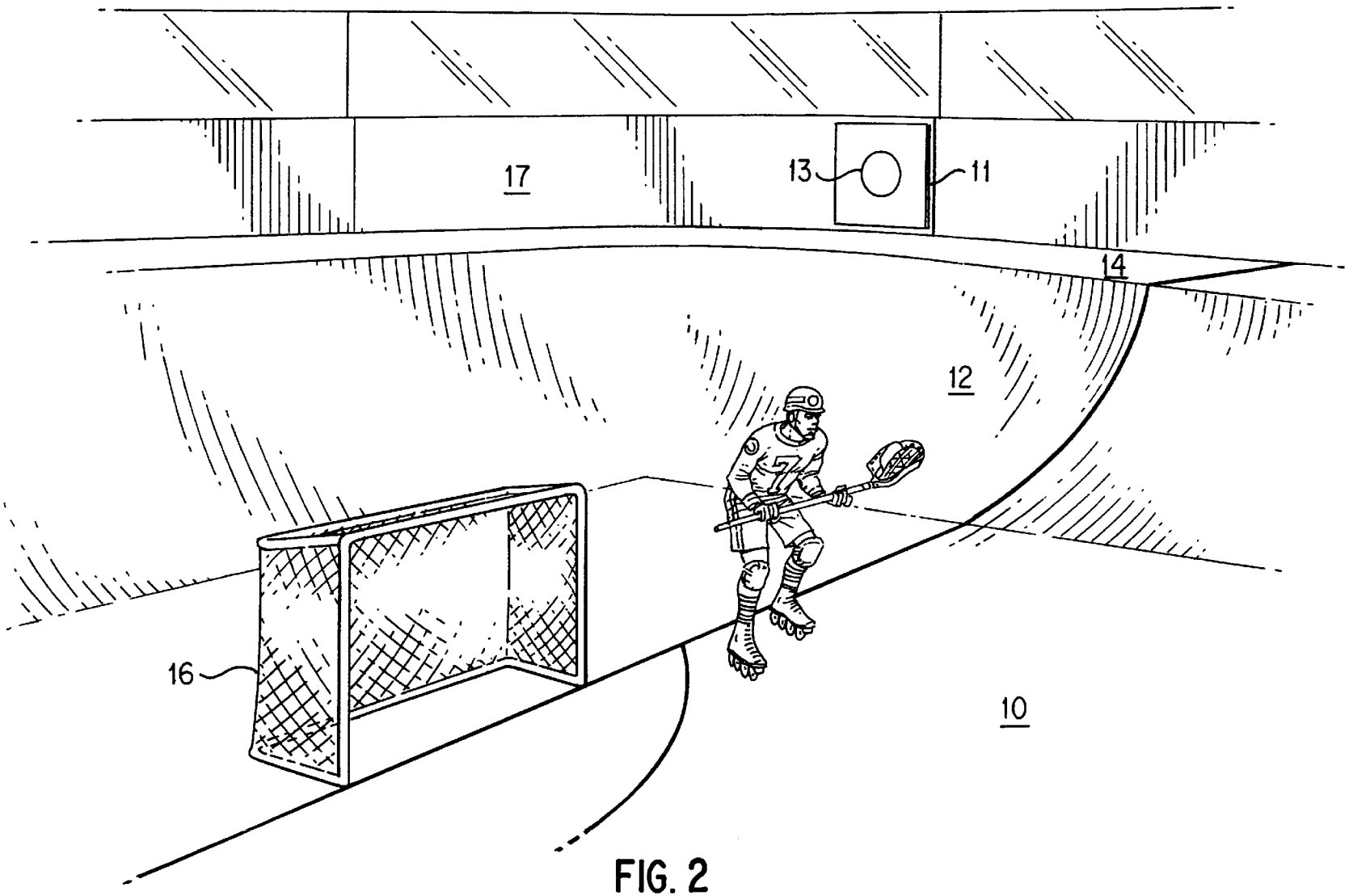
FIG. 2 is a perspective drawing of a portion of the playing surface.
Figure 3:
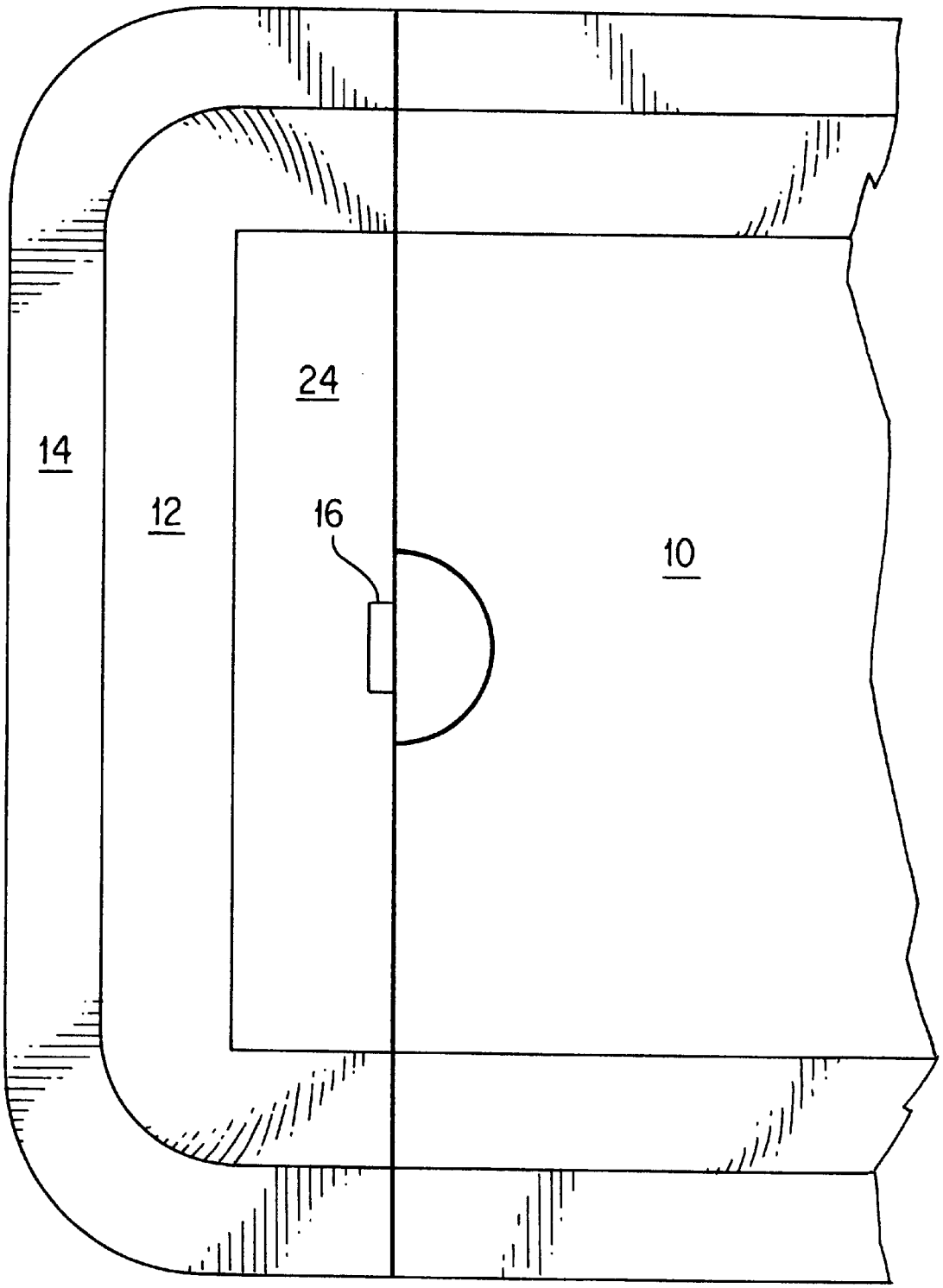
FIG. 3 is a top view of a portion of the playing surface according to FIG. 1 showing the proposed dimensions of the playing surface.

FIGS. 1–3 illustrate the rollercross rink design of the present invention. The rink design includes a planar main playing area 10 generally rectangular in shape extending for the majority of both the length and width of the rink. The main rink section 10 is completely surrounded by a curved ramp section 12. An elevated upper deck platform section 14 completely surrounds the curved ramp section 12. Therefore, during play, skaters would utilize the main skating surface 10, the curved ramp "half-pipe" surface 12 as well as the top planar surface 14. Sidewalls as well as end walls 17 completely surround the upper deck platform section 14. The purpose of the sidewall 15 as well as the end walls 17 are of course to delineate the outer dimensions of the playing surface, as well as to prevent the players as well as the balls 22 which would be utilized in this game from entering the spectator area. The side and end walls 15 and 17 are constructed from any durable material, such as wood or plastic. The entire surface of the side walls 15 and the end walls 17 could be constructed of clear plastic, allowing the spectators to view the entire action. Alternatively, sections of the side walls 15 or end walls 17 could be constructed from a clear plastic material 11. In this instance, a camera 13 can be placed behind this clear plastic section 11. A clear plastic wall section 19 would extend around the entire periphery of the playing surface and would be affixed to the top of the walls 15, 17. The exact height of the walls 15, 17 would approximately be 4 to 6 feet high. Additionally, the height of the clear plastic section 19 could also be approximately 4 to 6 feet high. The height of this section 19 could also change depending upon its location around the periphery of the playing surface. For example, the height of section 19 could be greater behind the nets area 16 than around the side walls 15.

The ramp section 12 includes two parallel ramped end surfaces and two parallel ramped side surfaces surrounding the substantially rectangular playing area 10. These end and side surfaces slope upwardly from the playing area 10 and terminate at the top planar surface 14. The ramp section 12 also includes four transition sections, one of each transition section provided between one of the ramped end surfaces and one of the ramped side surfaces. Each of the transition sections slopes upwardly from the planar playing area 10 to the elevated planar surface 14. Furthermore, each of the transition sections is provided with a side-to-side curvature between one of the ramped end surfaces and ore of the ramped side surfaces. Therefore, as illustrated particularly with respect to FIG. 2, the two ramped end surfaces and the two ramped side surfaces while sloping upwardly from the playing area 10 and terminating at the top planar surface 14, do not include side-to-side curvatures. However, all four of the transition sections slope upwardly from the playing area 10 and terminating at the top playing surface 14, as well as being provided with a side-to-side curvature.

The playing surface would include two nets 16 and will be played with modified lacrosse-type sticks 18 and balls 22. A center face-off circle 20 is provided similar in nature to that of ice hockey, roller hockey and lacrosse. A goal crease 21 as illustrated in FIG. 3 can also be provided in front of each of the nets 16. Furthermore, the main planar surface 10 includes two planar surfaces 24 provided behind each of the nets 16.

Although the exact dimensions of the playing surface are not crucial, FIG. 3 illustrates typical dimensions which could be utilized. It is noted that the rollercross rink or bowl, can fit inside any regulation size ice or inline skating rink provided with a playing surface at a minimum of 175 feet in length by 65 feet in width or at a maximum of 200 feet by 85 feet. The ramp walls could start approximately six to eight feet from the side boards 15. In this instance, the width of the upper deck would be approximately two to three feet and the ramp would with respect to the horizontal planar surface 10 of approximately 20–60°, perhaps depending upon the level of competition. The two planar surfaces 24 provided behind each of the nets 16*b* would extend approximately 10 feet from a goal line 23 to the beginning of the ramp surface 12 behind the net 16.

The rollercross game played on the above-described playing surface will now be described. Each of the players will utilize a stick 18 similar in nature to a standard lacrosse stick. However, it is noted that variations to this stick can be made. For instance, the length of the handle of the stick as well as the type of netting would vary based upon the position played by one of the players, such as goalie, attackman or defensemen. Each of the players wears protective gear, such as helmets, gloves, shoulder, hip, pelvic, elbow and knee pads. The goal net 16 would be similar to that of hockey which is four feet tall and six feet wide. A semi-hard rubber ball is used for regulation play.

Each team consists of 12 players. During play, three forwards, two defensemen, and one goalie are active in the bowl or rink area. The rules are similar to hockey. However, any intentional contact on the walls between players results on a penalty and instant removal from the game.

The game begins with a center face-off similar to lacrosse and hockey in the face-off circle 20. The objective is to manipulate the ball with the netted stick into your opponents goal to score a point. Unlike lacrosse, the ball may be rolled on the ground as in hockey, although the main movement of the ball will be airborne from net to net. Passing maneuvers are caught, carried, rolled or thrown. Line rushes, patterned offensive attacks, zone defense and man-to-man coverage similar to lacrosse and hockey are implemented. The play is constantly moving. There are no "out of bounds" and the area behind the goalie is an acceptable area of play. The game does not stop unless someone scores or a penalty occurs. Two referees man the "bowl" and severity of the penalty is at their discretion. Absolutely no checking is done on the walls and therefore contact is allowed only on the level floor portion 10. One game consists of four twelve minute quarters with teams alternating playing fields with each quarter. Two minutes are allowed between each quarter, as well as ten minutes for half time. Additionally, one time out is allowed for each team. A goal is scored when the ball is put between the goal post by the stick of a player of the attacking from in front, below the cross bar and entirely across the goal line. A goal is also scored if the ball is put into the goal in any by a player of the defending team. The player of the attacking side who last played the ball will be credited with the goal but no assist is to be awarded. If an attacking player kicks the ball and is deflected into the net by any player of the defending side, except the goaltender, the goal will be allowed. The player who kicked the ball will be credited with the goal, but no assist is to be awarded. If the ball has been deflected into the goal by a shot of an attacking player by striking any player on the same side, a goal will be allowed. The player who deflected the ball is to be credited with the goal. The goal will not be allowed if the ball has been kicked, thrown, or otherwise deliberately directed into the goal by any means other than a stick. Any goal scored other than as covered by the official rules will not be allowed. When a player scores a goal, an assist will be credited to the player or players who made the pass leading to a direct goal.

When a regular season game is tied at the end of regulation, a sudden death shoot-out would be implemented. There would be a one minute intermission period before the start of the shoot-out. Five players from each team will then attempt to score using a penalty shot format. Players from each team will alternate, with the visiting team having the first attempt.

Although the rollercross rink or bowl as been described with respect to a game played by participants using inline skates, the type of surface should not be so limited. For example, when used with inline skates, the composition of the playing surface would be similar to that of an inline skating rink or a roller hockey skating rink. However, if the rink as described hereinabove were covered with ice, the players would employ ice skates. In that instance, the game could be played utilizing the same rules as well as equipment employed in ice hockey or could utilize the lacrosse sticks and ball employed in lacrosse.

What is claimed is:

1. A rink for playing a game comprising:

a planar playing surface defined by two parallel end lines and two parallel side lines;

a ramped playing surface completely surrounding said planar playing surface; and an elevated planar platform playing surface completely surrounding said ramped playing surface.

2. The rink in accordance with claim 1, further including a wall surrounding said elevated platform surface.

3. The rink in accordance with claim 2, wherein said wall comprises a first lower section and a second transparent upper portion.

4. The rink in accordance with claim 3 wherein said first lower section includes at least one section which is transparent.

5. The rink in accordance with claim 4, wherein said first lower section is completely transparent.

6. The rink in accordance with claim 1, further including a pair of goal nets, each of said nets situated opposite one another on said planar playing surface in front of one of the end lines.

7. The rink in accordance with claim 6 wherein said side lines are longer in length than said end lines.

8. A rink for playing a game comprising:

a planar playing surface defined by two parallel end lines and two parallel side lines;

a ramped playing surface completely surrounding said planar playing surface, said ramped playing surface comprising, first and second ramped end surfaces substantially parallel to said parallel end lines, first and second ramped side surfaces substantially parallel to said parallel side lines, each of said first and second ramped end surfaces and each of said first and second ramped side surfaces sloping upwardly from said planar playing surface, said ramped playing surface further comprising first, second, third and fourth ramped transition sections, each of said ramped transition sections provided between one of said ramped end surfaces and one of said ramped side surfaces, each of said ramped transition sections sloping upwardly from said planar playing surfaces and provided with a side-to-side curvature between one of said ramped end surfaces and one of said ramped side surfaces; and an elevated, planar platform playing surface completely surrounding said ramped playing surface.

9. The rink in accordance with claim 8, further including a wall surrounding said elevated planar platform playing surface.

10. The rink in accordance with claim 9, wherein said wall comprises a first lower section and a second transparent upper portion.

11. The rink in accordance with claim 10, wherein said first lower section includes at least one section which is transparent.

12. The rink in accordance with claim 11, wherein said first lower section is completely transparent.

13. The rink in accordance with claim 8, further including a pair -of goal nets, each of said nets situated opposite one another on said planar playing surface in front of one of the end lines.

14. The rink in accordance with claim 13, wherein said side lines are longer in length than said end lines.

* * * * *